US007777561B2

(12) United States Patent
Wang

(10) Patent No.: US 7,777,561 B2
(45) Date of Patent: Aug. 17, 2010

(54) ROBUST CURRENT MIRROR WITH IMPROVED INPUT VOLTAGE HEADROOM

(75) Inventor: Donghui Wang, Shanghai (CN)

(73) Assignee: LSI Corporation, Milpitas, CA (US)

( * ) Notice: Subject to any disclaimer, the term of this patent is extended or adjusted under 35 U.S.C. 154(b) by 0 days.

(21) Appl. No.: 12/182,174

(22) Filed: Jul. 30, 2008

(65) Prior Publication Data

US 2010/0026365 A1 Feb. 4, 2010

(51) Int. Cl.
*G05F 1/10* (2006.01)
*G05F 3/02* (2006.01)

(52) U.S. Cl. ..... 327/543; 327/541; 327/546; 323/313

(58) Field of Classification Search ..... 327/530, 327/538–543, 546; 323/312–317
See application file for complete search history.

(56) References Cited

U.S. PATENT DOCUMENTS 5,394,079 A 2/1995 Llewellyn ..... 323/315
2004/0124908 A1* 7/2004 Lei ..... 327/538
2004/0140844 A1* 7/2004 Lee ..... 327/539
2004/0164790 A1* 8/2004 Moon et al. ..... 327/546
2009/0045869 A1* 2/2009 Kudo ..... 327/538

* cited by examiner

*Primary Examiner*—Lincoln Donovan
*Assistant Examiner*—Brandon S Cole
(74) *Attorney, Agent, or Firm*—Christopher P. Maiorana, PC

(57) ABSTRACT

An apparatus comprising an input current source device, a first transistor, a second transistor and a level shifter device. The input current source device may provide a input current source. The first transistor may be configured to operate in saturation for mirroring the input current source to an output current source. The first transistor may have (i) a source node connected to a supply, and (ii) a drain connected to the input current source. The second transistor may also be configured to operate in saturation. The second transistor may have (i) a gate connected to a gate of the first transistor, (ii) a source connected to the supply, and (iii) a drain configured as an output current node. The level shifter device may comprise a third transistor, a first bias current source and a second bias current source.

17 Claims, 5 Drawing Sheets

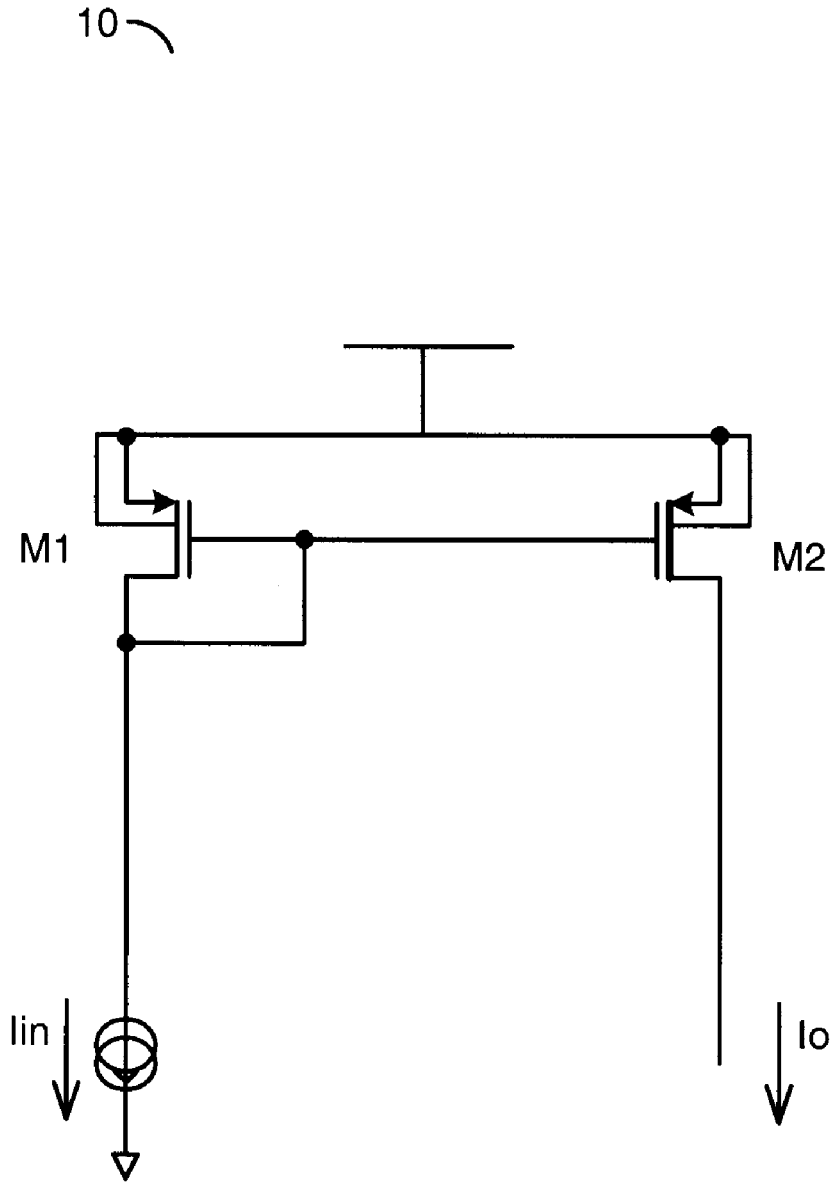
FIG. 1
(CONVENTIONAL)

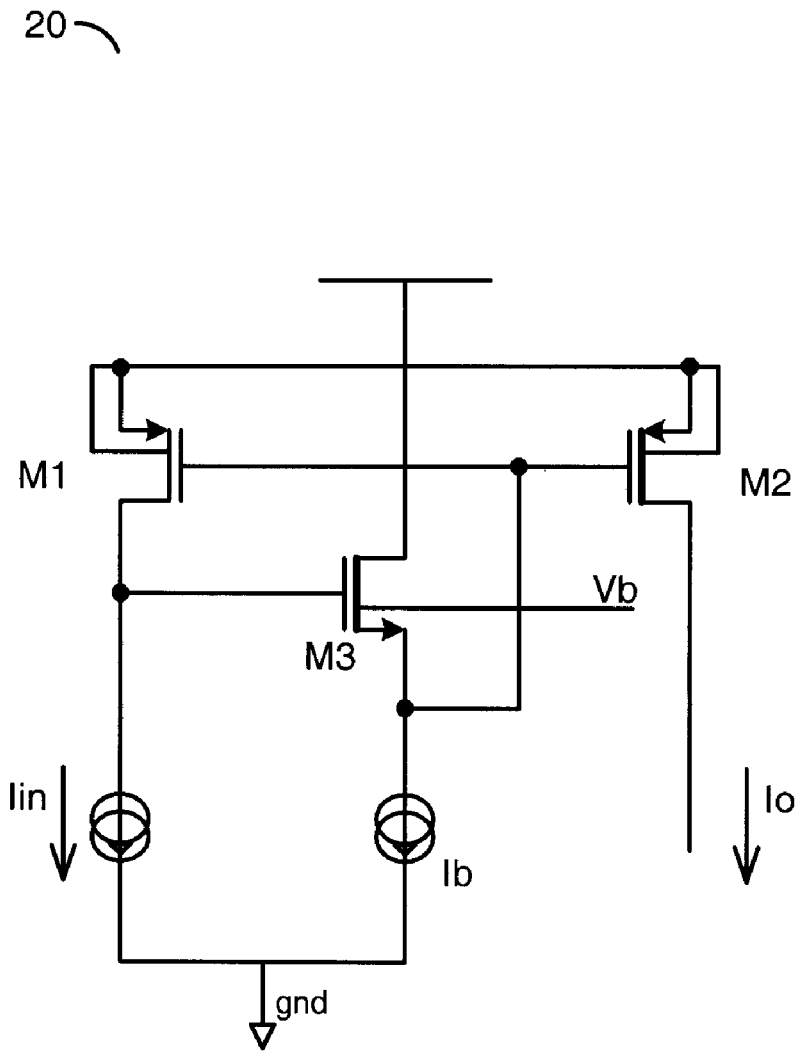
FIG. 2
(CONVENTIONAL)

ROBUST CURRENT MIRROR WITH IMPROVED INPUT VOLTAGE HEADROOM

FIELD OF THE INVENTION

The present invention relates to current mirror circuits generally and, more particularly, to a method and/or apparatus for implementing a robust current mirror with improved input voltage headroom.

BACKGROUND OF THE INVENTION

Referring to FIG. 1, a conventional current mirror circuit 10 is shown. The circuit 10 includes a MOSFET M1, a MOSFET M2, an input current Iin, and an output current Io. The MOSFET M1 is connected as a diode that operates in saturation. The MOSFET M1 has a channel that carries the input current Iin. The MOSFET M2 also operates in saturation. The MOSFET M2 has a channel that carries the output current Io. The gates of the MOSFET M1 and the MOSFET M2 are connected together to ensure identical control voltages (i.e., gate to source voltages). Identical control voltages on the MOSFET M1 and the MOSFET M2 results in the input current Iin being mirrored to the output current Io. The ratio of the input current to the output current (Io/Iin) depends on the dimensions of the MOSFET M1 and the MOSFET M2.

To simplify the analysis in this context, if the MOSFETs M1 and M2 are considered to have the same dimensions, then Io=Iin.

The term "saturation" refers to an operating condition which applies to the following equation EQ1:

$$V_{ds} > V_{gs} - V_{th} = V_{ov} \quad \text{(EQ1)}$$

where:

Vds is a drain to source voltage,

Vgs is a gate to source voltage (control voltage),

Vth is a threshold voltage, and

Vov is an overdrive voltage necessary to establish current flow through the channel.

The input voltage headroom is defined by the following equation EQ2:

$$V_{vh} = V_{vdda} - V_{gs,M1} = V_{vdda} - (V_{th,M1} + V_{ov,M1}) \quad \text{(EQ2)}$$

where:

Vvh represents input voltage headroom, and

Vvdda is the positive supply voltage minus ground supply voltage.

Referring to FIG. 2, a diagram of a circuit 20 is shown. The circuit 20 has improved input voltage headroom compared with the circuit 10 and is described in U.S. Pat. No. 5,394,079. The circuit 20 adds an N-type MOSFET M3 and a bias current Ib. A P-type current mirror includes a MOSFET M1 and a MOSFET M2. The N-type MOSFET M3 and the bias current Ib combine to form a level shifter. The bulk connection Vb is used to adjust the threshold voltage of the MOSFET M3.

The input voltage headroom of the circuit 20 is defined by the following equation EQ3:

$$V_{vh} = V_{vdda} - V_{gs,M1} + V_{gs,M3} = V_{vdda} - (V_{th,M1} + V_{ov,M1}) + V_{gs,M3} \quad \text{(EQ3)}$$

The following equation EQ4 ensures the MOSFET M1 works in saturation mode:

$$V_{ds,M1} = V_{vdda} - V_{vh} = V_{th,M1} + V_{ov,M1} - V_{gs,M3} > V_{ov,M1} \quad \text{(EQ4)}$$

The threshold voltage of the MOSFET M1 minus the gate to source voltage of the MOSFET M3 should be greater than zero.

The circuit 20 implements the MOSFET M1 and the MOSFET M3 as different types of MOSFETs, having different threshold voltages and different values. The gate to source voltage of the MOSFET M3 must be adjusted to satisfy the saturation condition. For the circuit 20, the bulk of the N-type MOSFET M3 is connected to a bias voltage Vb. The bulk bias voltage Vb is adjusted by a voltage bias generator circuit to a value higher than ground potential to help reduce the gate to source voltage of the MOSFET M3. Such an implementation has very limited headroom and has problems when the PN junction of the MOSFET M3 is turned on.

Even when adjusting the bias voltage Vb, the circuit 20 faces other problems. Since the MOSFET M1 and the MOSFET M3 use different types of transistors, different process variations, temperature changes and trends will occur, even if the MOSFET M1 and the MOSFET M3 have the same trends but have different velocities. By using the circuit 20, the value of the gate to source voltage of the transistor M3 should be a small value which gives an enough margin for the MOSFET M1 to operate in saturation. A small gate to source voltage on the transistor M3 ultimately deteriorates the efficiency of the circuit 20.

It would be desirable to implement a current mirror with sufficient headroom when operating in a low voltage application.

SUMMARY OF THE INVENTION

The present invention concerns an apparatus comprising an input current source device, a first transistor, a second transistor and a level shifter device. The input current source device may provide a input current source. The first transistor may be configured to operate in saturation for mirroring the input current source to an output current source. The first transistor may have (i) a source node connected to a supply, and (ii) a drain connected to the input current source. The second transistor may also be configured to operate in saturation. The second transistor may have (i) a gate connected to a gate of the first transistor, (ii) a source connected to the supply, and (iii) a drain configured as an output current node. The level shifter device may comprise a third transistor, a first bias current source and a second bias current source.

The objects, features and advantages of the present invention include providing an integrated current mirror circuit that may (i) overcome one or more disadvantages of conventional designs, (ii) improve input voltage headroom, (iii) provide a simple design to implement, (iv) maintain performance over process variations, and/or (v) be feasible to implement in low voltage supply applications.

BRIEF DESCRIPTION OF THE DRAWINGS

These and other objects, features and advantages of the present invention will be apparent from the following detailed description and the appended claims and drawings in which:

FIG. 1 is a diagram of a conventional P-type MOSFET current mirror;

FIG. 2 is a more detailed diagram of a conventional P-type MOSFET current mirrors which utilizes an additional N-type MOSFET for level shifter to improve the input voltage headroom;

DETAILED DESCRIPTION OF THE PREFERRED EMBODIMENTS

With technology scaling, transistors and supply voltages are continuing to get smaller. Circuit designs relating to low voltage supply applications are becoming more important. One embodiment of the present invention concerns Integrated Circuits (ICs) and more particularly to low voltage analog applications that use current mirror circuits. One embodiment of the present invention concerns an integrated current mirror circuit that overcomes the disadvantages of conventional designs while improving input voltage headroom.

Figure 3:
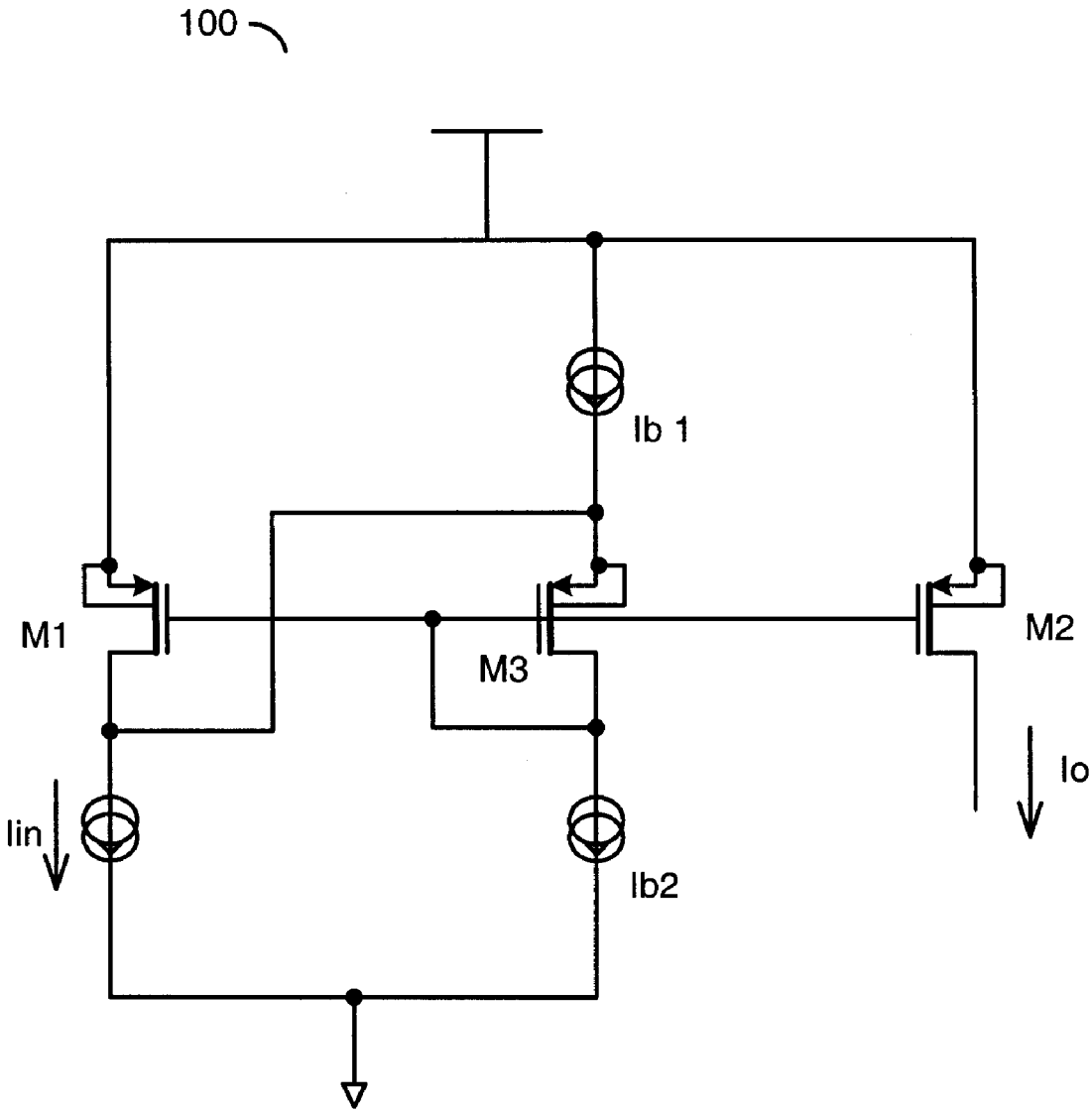
FIG. 3 is a diagram of an embodiment of an all P-type MOSFET current mirror in accordance with the present invention.

Referring to FIG. 3, a diagram of a circuit 100 illustrating an embodiment of the present invention is shown. The circuit 100 may maintain performance over process variations. The circuit 100 may be feasible to implement in low voltage supply applications. The circuit 100 generally comprises a transistor M1, a transistor M2, a transistor M3, a current source Ib1, a current source Ib2 and a current source Iin. The circuit 100 may be implemented, in one example, using all P-type MOSFETs. However, other transistor types may be implemented to meet the design criteria of a particular implementation. In one example, the transistor M1 may be implemented as a MOSFET transistor. In one example, the transistor M2 may be implemented as a MOSFET transistor. In one example, the transistor M3 may be implemented as a MOSFET transistor. However, other transistor types may be implemented to meet the design criteria of a particular implementation.

In one example, the transistor M3 may be implemented as a P-type MOSFET. The transistor M3 may have a diode connected type. The current source Ib1 and the current source Ib2 may have the same or similar current values. The current source Ib1 and the current source Ib2 may channel current of the transistor M3.

The input voltage headroom for the circuit 100 may be defined by the following equation EQ5:

$$V_{vh}=V_{vdda}-V_{gs,M1}+V_{gs,M3}=V_{vdda}-(V_{th,M1}+V_{ov,M1})+V_{gs,M3} \quad \text{(EQ5)}$$

Equation EQ5 looks similar to equation EQ3, which was derived from FIG. 2, but with the transistor M3 implemented as a different type of MOSFET. In general, the input voltage headroom for the circuit 100 is bigger than the input voltage of conventional designs.

To make sure the transistor M1 works in saturation mode, the following equation EQ6 may be satisfied:

$$V_{ds,M1}=V_{vdda}-V_{vh}=V_{th,M1}+V_{ov,M1}-V_{gs,M3}>V_{ov,M1} \quad \text{(EQ6)}$$

A condition that the drain to source voltage of the transistor M1 minus the gate to source voltage of the transistor M3 is greater than zero may be satisfied.

To satisfy the saturation condition, the working condition of the transistor M3 may be set to a sub-threshold region (or deep sub-threshold region). With this, the transistor M3 may meet the criteria that the gate to source voltage of the transistor M3 minus the threshold voltage of the transistor M3 is less than or equal to −50 mV. If the transistor M1 and the transistor M3 have the same threshold voltage, which approximates to real conditions. Then the following equation EQ7 may be deduced from EQ6:

$$V_{ds,M1}=V_{th,M1}+V_{ov,M1}-V_{gs,M3}\geqq V_{ov,M1}+50\text{ mV} \quad \text{(EQ7)}$$

Equation EQ7 satisfies the condition described. Compared with circuit 20, the circuit 100 may have the bulk of transistor M3 tied to supply. Such an implementation may eliminate the need for a bulk bias generation circuit and/or the design work of carefully adjusting the voltage bias Vb.

Unlike conventional designs, the circuit 100 may be implemented using all of the same type of MOSFET devices for the current mirror. The parameters of the transistor M1, the transistor M2 and the transistor M3 may all have the same trends and close velocities with regard to process variations, temperature changes and supply voltage ripples. For the parameters indicated, across all PVT (process variation, voltage supply, temperature) the circuit 100 may have a small value variance for the difference between the threshold of transistor M1 and the gate to source transistor of M3. Referring back to EQ6, the difference between the drain to source voltage M1 and overdrive voltage of M1 has a small variance as well. The transistor M1 may work in the saturation region across all PVT. The circuit 100 may have a large gate to source voltage of transistor M3, as shown in equation EQ5. The circuit 100 may improve upon the input voltage headroom compared with convention approaches.

The circuit 100 may have a mismatch between current sources Ib1 and Ib2. The difference between the current source Ib1 and the current source Ib2 (Ib1−Ib2) may be added to the input current Iin. The output current may be a ratio of (Iin+Ib1−Ib2) instead of Iin. To weaken or remove this drawback, the value of the currents Ib1 and Ib2 may be designed to be less than the value of the current Iin, since the mismatch between the current Ib1 and the current Ib2 (e.g., Ib1−Ib2) is far less than either the current Ib1 or the current Ib2. This mismatch may induce an error for the current mirror that may be ignored compared with the current mirror systematic error (e.g., the Vds mismatch between the transistor M1 and the transistor M2 induced error).

Figure 4:
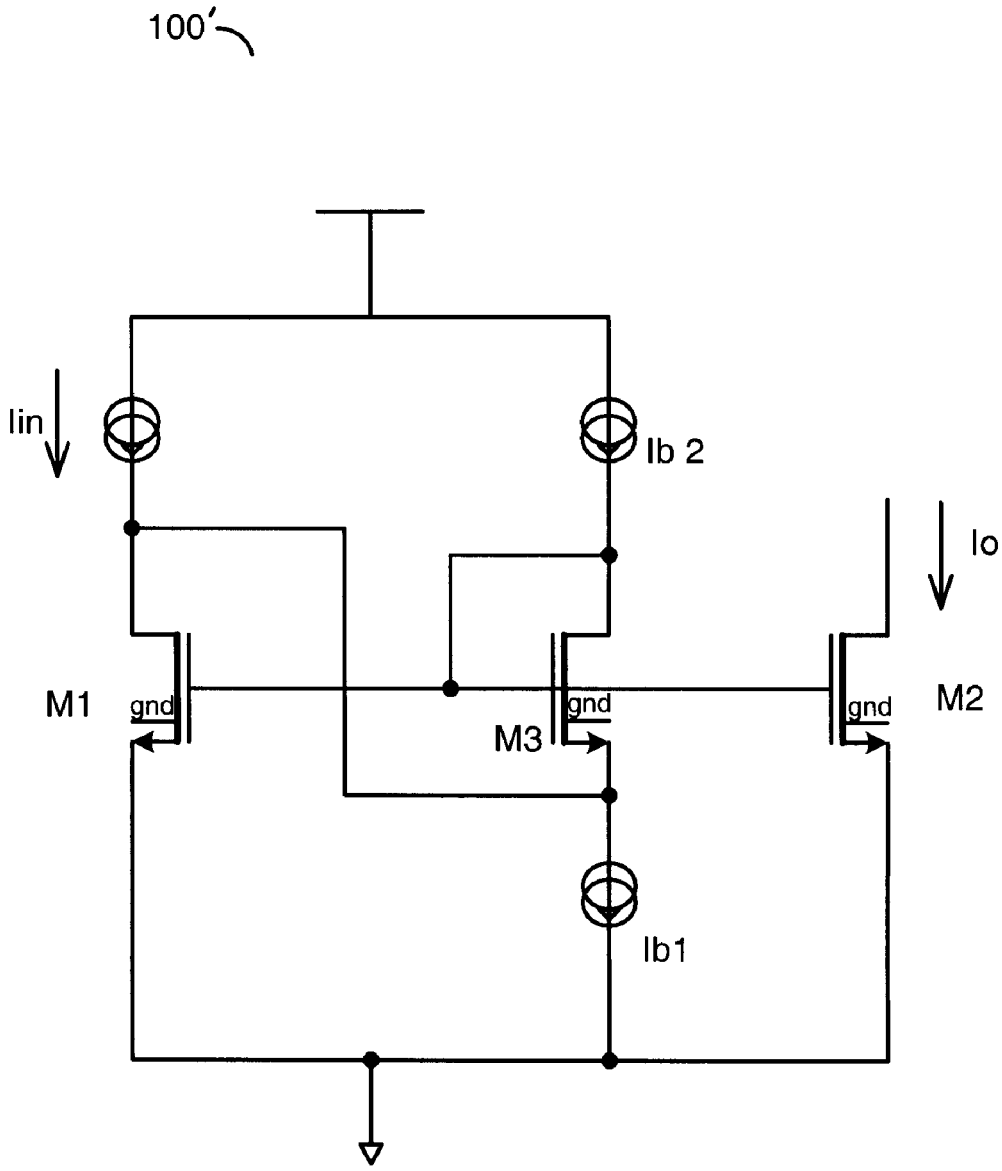
FIG. 4 is a more detailed diagram of an embodiment of an all N-type MOSFET current mirror in accordance with the present invention.

Referring to FIG. 4, a diagram of an embodiment of the circuit 100' is shown. The circuit 100' is shown implemented using all N-type MOSFETS. The circuit 100' is similar to the circuit 100 except different types of MOSFETs are implemented for the current mirror.

Figure 5:
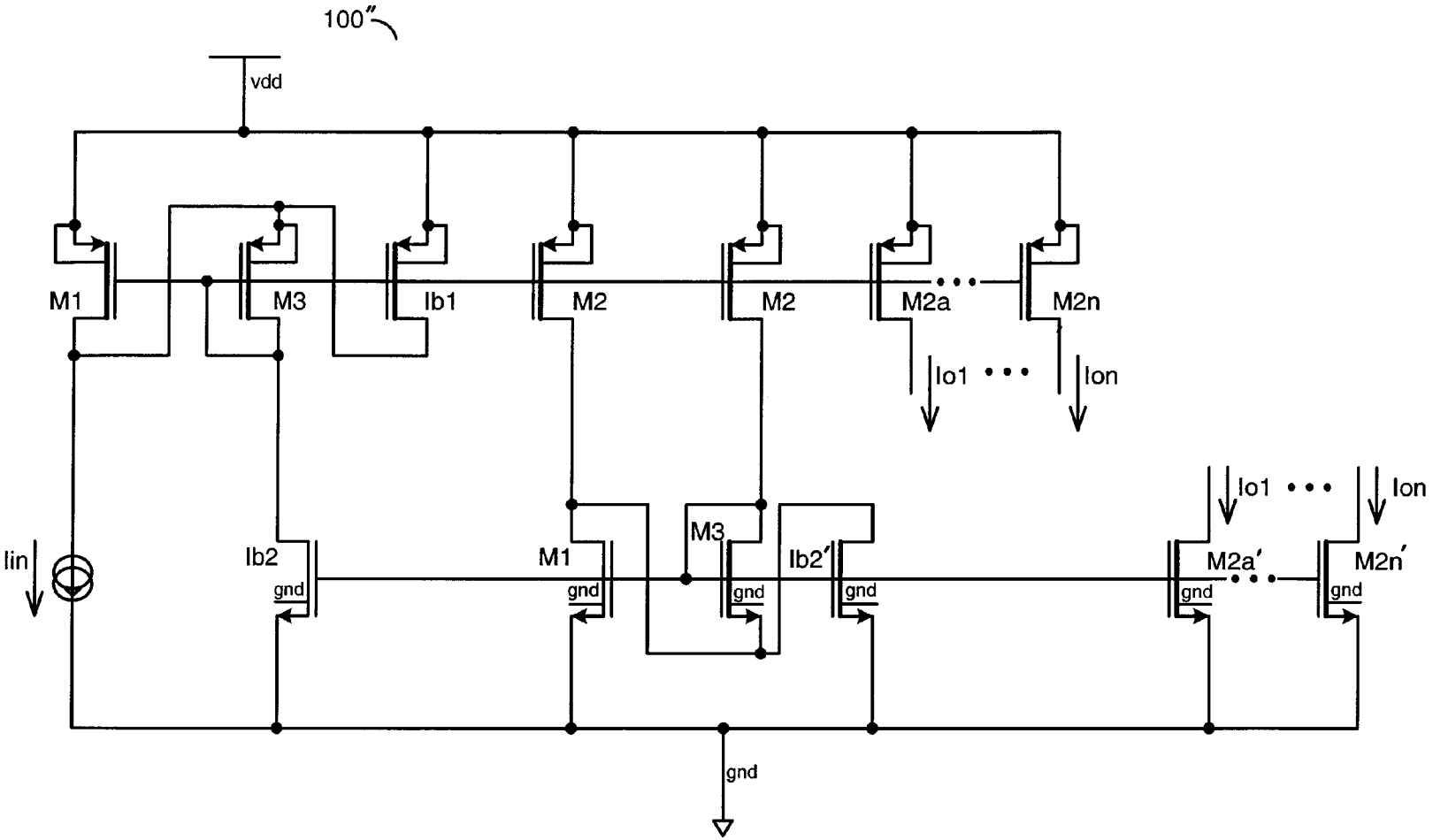
FIG. 5 is a diagram illustrating an implementation of the present invention.

Referring to FIG. 5, a diagram of a circuit 100" is shown illustrating an embodiment that provides both current sinks and current sources. The circuit 100" illustrates a practical implementation that may be suitable for low voltage applications. The circuit 100" generally comprises the transistor M1', a transistor M1", a number of transistors M2*a*-M2*n*, a number of transistors M1*a*'-M2*n*', the current source Ib1, the current source Ib2, a current source Ib2'. The transistors M2*a*'-M2*n*' illustrate the transistor M2 from FIG. 3 broken into multiple devices. The current source Ib2' illustrates the current source Ib2 of FIG. 4. The transistors M2*a*'-M2*n*' may represent the transistor M2 of FIG. 4 implemented as multiple devices.

While the invention has been particularly shown and described with reference to the preferred embodiments thereof, it will be understood by those skilled in the art that various changes in form and details may be made without departing from the scope of the invention.

The invention claimed is:

1. An apparatus comprising:

an input current source device for providing an input current source;

a first transistor configured to operate in saturation for mirroring said input current source to an output current source, said first transistor having (i) a source connected to a supply, and (ii) a drain connected to said input current source;

a second transistor configured to operate in saturation, said second transistor having (i) a gate connected to a gate of said first transistor, (ii) a source connected to said supply, and (iii) a drain configured as an output current node; and a level shifter device comprising a third transistor, a first bias current source and a second bias current source, wherein said third transistor (a) operates in a sub-threshold region, and (b) has a source connected to a drain of said first transistors.

2. The apparatus according to claim 1, wherein said third transistor comprises (i) a gate connected to said gate of said first transistor and said second transistor, (ii) a source connected to said drain of said first transistor, (iii) said first bias current source, (iv) a drain connected to a gate and (v) said second bias current source.

3. The apparatus according to claim 1, wherein said first transistor, said second transistor and said third transistor comprise MOSFETs.

4. The apparatus according to claim 3, wherein said first transistor, said second transistor and said third transistor are configured as P-type MOSFETs.

5. The apparatus according to claim 4, further comprising:

a second input current source device for providing a second input current source;

a fourth transistor configured to operate in saturation for mirroring said second input current source to an output current source, said fourth transistor having (i) a source connected to a supply, and (ii) a drain connected to said second input current source;

a fifth transistor configured to operate in saturation, said second transistor having (i) a gate connected to a gate of said fourth transistor, (ii) a source connected to said supply, and (iii) a drain configured as an output current node; and a second level shifter device comprising a sixth transistor, a third bias current source and a fourth bias current source, wherein said sixth transistor operates in a sub-threshold region.

6. The apparatus according to claim 3, wherein said first transistor, said second transistor and said third transistor are configured as N-type MOSFETs.

7. The apparatus according to claim 1, wherein said third transistor comprises a MOSFET connected as a diode.

8. The apparatus according to claim 7, wherein said third transistor is biased by a bias current less than said input current.

9. The apparatus according to claim 1, wherein said first bias current source and said second bias current source are channel currents of said third transistor.

10. The apparatus according to claim 1, wherein a gate to source voltage of said first transistor is greater than a gate to source voltage of said third transistor.

11. The apparatus according to claim 1, wherein said connection between said source of said third transistor and said drain of said first transistor creates a mismatch between said first bias current source and said second bias current source.

12. The apparatus according to claim 11, wherein said mismatch between said first bias current source and said second bias current source is added to said input current source.

13. The apparatus according to claim 1, wherein said supply is voltage greater than zero.

14. The apparatus according to claim 1, wherein said input current source and said second bias current source is connected to a ground node with a voltage less than said supply.

15. An apparatus comprising:

means for providing an input current source;

means for a first transistor configured to operate in saturation for mirroring said input current source to an output current source, said first transistor having (i) a source connected to a supply, and (ii) a drain connected to said input current source;

means for a second transistor configured to operate in saturation, said second transistor having (i) a gate connected to a gate of said first transistor, (ii) a source connected to said supply, and (iii) a drain configured as an output current node; and means for a level shifter device comprising a third transistor, a first bias current source and a second bias current source, wherein said third transistor (a) operates in a sub-threshold region, and (b) has a source connected to a drain of said first transistors.

16. The apparatus according to claim 15, wherein said third transistor comprises (i) a gate connected to said gate of said first transistor and said second transistor, (ii) a source connected to said first bias current source, (iii) a drain connected to a gate and (iv) a third bias current source.

17. A method for implementing a current mirror, comprising the steps of:

(A) receiving an input current source;

(B) implementing a first transistor operating in saturation for mirroring said input current source to an output current source, said first transistor having (i) a source connected to a supply, and (ii) a drain connected to said input current source;

(C) implementing a second transistor operating in saturation, said second transistor having (i) a gate connected to a gate of said first transistor, (ii) a source connected to said supply, and (iii) a drain configured as an output current node; and (D) implementing a level shifter device comprising a third transistor, a first bias current source and a second bias current source, said third transistor (a) operates in a sub-threshold region, and (b) has a source connected to a drain of said first transistors.

* * * * *